US006639562B2

(12) United States Patent
Suganthan et al.

(10) Patent No.: US 6,639,562 B2
(45) Date of Patent: Oct. 28, 2003

(54) GSM/DCS STUBBY ANTENNA

(75) Inventors: Shanmuganthan Suganthan, North Harrow (GB); Peter Webster, Milton Keynes (GB)

(73) Assignee: Centurion Wireless Tech., Inc., Lincoln, NE (US)

( * ) Notice: Subject to any disclaimer, the term of this patent is extended or adjusted under 35 U.S.C. 154(b) by 0 days.

(21) Appl. No.: 10/021,808

(22) Filed: Dec. 17, 2001

(65) Prior Publication Data

US 2003/0112203 A1 Jun. 19, 2003

(51) Int. Cl.[7] ..... H01Q 1/24; H01Q 1/36
(52) U.S. Cl. ..... 343/702; 343/895
(58) Field of Search ..... 343/702, 895, 343/900, 715, 745

(56) References Cited

U.S. PATENT DOCUMENTS

| | | | | |
|---|---|---|---|---|
| 5,218,372 A | | 6/1993 | Cheng | 343/749 |
| 5,300,940 A | | 4/1994 | Simmons | 343/749 |
| 5,812,097 A | | 9/1998 | Maldonado | 343/790 |
| 5,963,170 A | | 10/1999 | Garner et al. | 343/702 |
| 6,052,088 A | | 4/2000 | Simmons et al. | 343/702 |
| 6,337,669 B1 | * | 1/2002 | Chiang | 343/895 |
| 6,452,555 B1 | * | 9/2002 | Chang et al. | 343/702 |

FOREIGN PATENT DOCUMENTS

| | | | |
|---|---|---|---|
| EP | 0 747 990 A1 | 11/1996 | H01Q/1/24 |

* cited by examiner

*Primary Examiner*—Hoang Nguyen
(74) *Attorney, Agent, or Firm*—Holland & Hart

(57) ABSTRACT

A stubby antenna comprising a RF conductive connector stud having opposite ends with the stud including means for mounting the antenna in the mounting hole of a communications device such as a cellular telephone. The stud is press-fitted into a body member with the body member having an opening or compartment formed therein which receives a coilform having a coil radiating element and a center wire. The coil radiating element is comprised of a plurality of first coils and a plurality of second coils with the first plurality of coils having a different pitch than the second plurality of coils. The center wire of the radiating element extends through the coils and through the actual bore formed in the coilform. A sheath encloses the body member with the sheath, body member, conductor stud and radiating element being arranged such that the radiating element is held in compression, ensuring that a good electrical contact is made between the connector stud and the radiating element.

5 Claims, 1 Drawing Sheet

GSM/DCS STUBBY ANTENNA

BACKGROUND OF THE INVENTION

1. Field of the Invention

The present invention relates to a stubby antenna and more particularly to a stubby antenna including a novel radiating element for wireless communications devices such as cellular telephones or the like.

2. Description of the Related Art

It has been found to be desirable to provide an antenna for wireless communications devices such as cellular telephones wherein the antenna has the ability to resonate at two frequencies. In the past, to enable an antenna to resonate at two frequencies, it was necessary to have two radiating elements. One practice is to make two separate elements, specifically a coil and a straight wire which are then crimped to a common connector. Another practice has been to make a coil which has two or more different pitches. The single coil with a dual/variable pitch has the advantage of fewer parts and one less assembly operation. However, the RF performance of the single coil approach is not as good as using two elements. When a stubby antenna is being designed, it is desirable to have the stubby antenna as short as possible while maintaining the RF performance.

SUMMARY OF THE INVENTION

A dual band stubby antenna is described for use with a wireless communications device such as a cellular telephone or the like having an antenna mounting opening formed therein. A RF conductive connector stud is received within the antenna mounting opening of the communications device. The stud is press-fitted into one end of an elongated body member which extends from one end thereof. The body member has a central opening formed therein which is adapted to receive a coilform having a coil radiating element received therein. The coil radiating element is preferably mounted on a coilform having an axial bore formed therein. The radiating element comprises a first plurality of coils and a second plurality of coils with the first plurality of coils having a different pitch than the second plurality of coils. The radiating element also includes a center wire which extends from one end of the radiating element through the coils. One end of the radiating element is in contact with the inner end of the connector stud. A sheath embraces the body member with the sheath, radiating element, connector stud and body being arranged so that the radiating element is held in compression, ensuring a good electrical contact being made between the connector stud and the radiating element. The antenna of this invention provides a multiple response frequency radiating element for a mobile wireless communications device with the center wire of the radiating element enabling the actual length of the radiating element to be reduced while maintaining an acceptable electrical performance.

It is a principal object of the invention to provide a stubby antenna including a multiple frequency response radiating element.

A further object of the invention is to provide a radiating element for a stubby antenna wherein a center wire is utilized to enable the actual length of the radiating element to be reduced while maintaining an acceptable electrical performance.

Still another object of the invention is to provide an antenna of the type described above wherein the connection between the radiating element and the antenna connector is maintained by compressing the radiating element.

Still another object of the invention is to provide an antenna of the type described above wherein the number of parts normally required has been reduced.

Still another object of the invention is to provide an antenna wherein the antenna is simple to assemble since the parts snap together with no additional operations being required.

These and other objects will be apparent to those skilled in the art.

DESCRIPTION OF THE PREFERRED EMBODIMENTS

Figure 1:
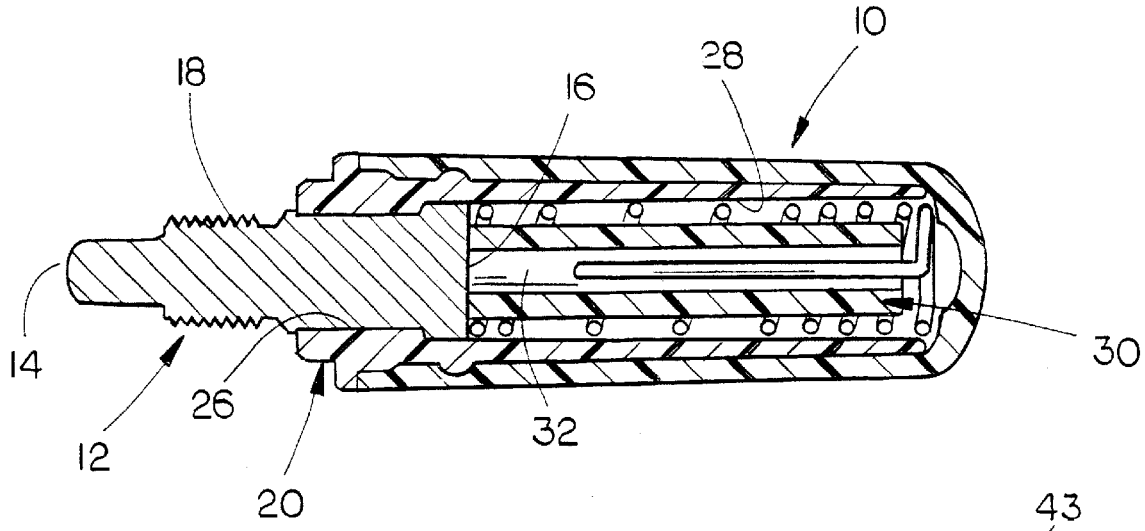
FIG. 1 is sectional view of the antenna of this invention.
Figure 2:
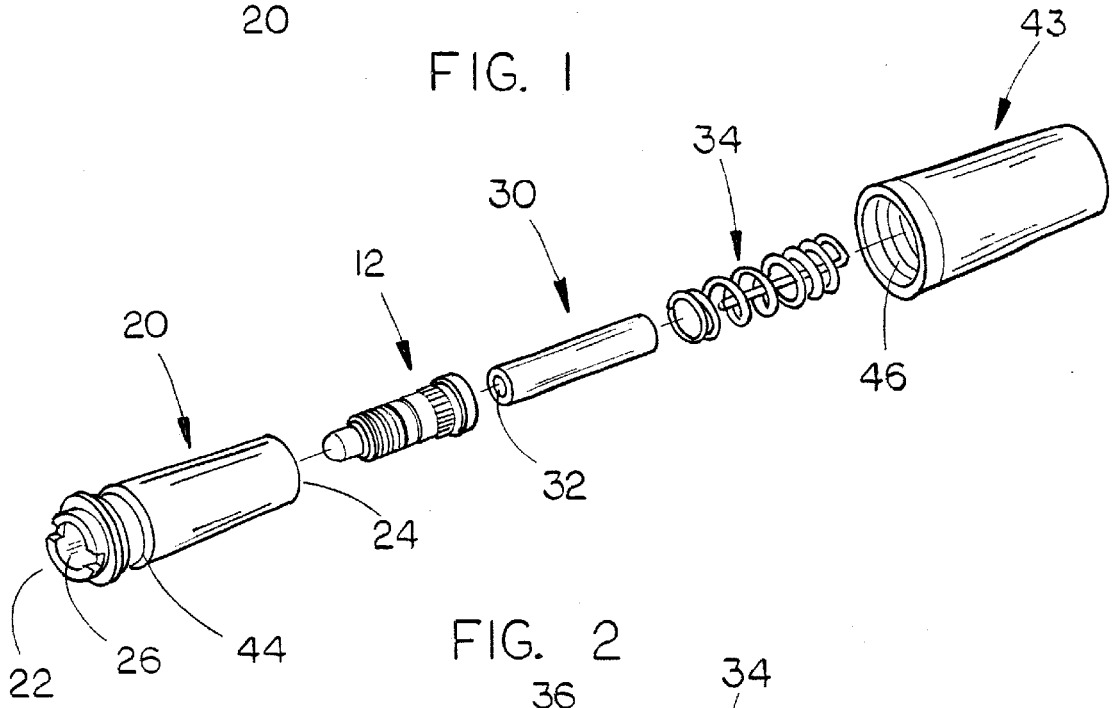
FIG. 2 is an exploded perspective view of the antenna of this invention.

The stubby antenna of this invention is referred to generally by the reference numeral 10 and is designed to be used on a wireless communications device such as a cellular telephone or the like. Antenna 10 includes a connector stud 12 having ends 14 and 16. Stud 12 is preferably comprised of brass and is preferably coated or plated with a nickel material. Stud 12 is provided within external threads 18 formed therein between its ends for threadable connection to the internally threaded antenna mounting hole or opening in the communications device so that stud 12 will be RF connected to the circuitry of the communications device. Although a threaded connection is contemplated, the stud 12 could have snap-in features to permit the antenna to be snapped into the antenna mounting hole of the communications device, if so desired. The end 16 of stud 12 is preferably flat, as shown in FIG. 1, as will be explained hereinafter.

The stud 12 is press-fitted into a non-conductive body member 20 having a first end 22 and a second end 24. Body member 20 has an opening 26 extending thereinto from end 22 which is adapted to receive the stud 12, as illustrated in FIG. 1. Body member 20 is also provided with a cylindrical opening 28 which extends thereinto from end 24 and which communicates with opening 26, as seen in FIG. 1.

The numeral 30 refers to a cylindrical coilform having an axial bore 32 extending therethrough. Coilform 30 is made from a suitable dielectric material such as thermoplastic polyurethane. The use of a coilform is preferred, but may not be necessary in all designs.

Figure 3:
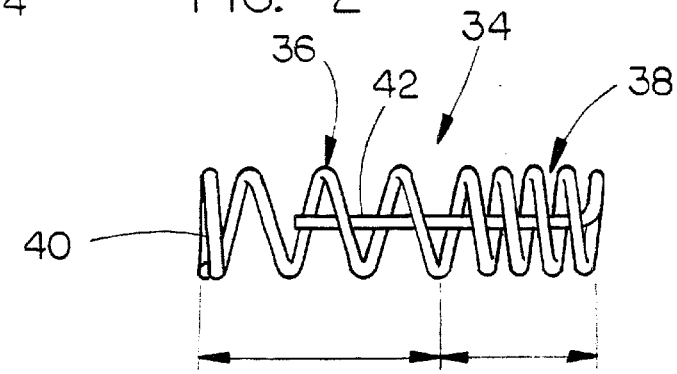
FIG. 3 is a side view of the coil radiating element of this invention.

The numeral 34 designates a coil radiator element (FIG. 3) which is provided with a first plurality of coils 36 and a second plurality of coils 38. As seen in FIG. 3, the coils 36 have a different pitch than the coils 38. The diameters of the coils 36 and 38 could also be different. The effect of the difference in pitch (and/or diameter) is to provide resonance at different frequencies. As seen in the drawings, the coils 36 terminate in a closed turn generally indicated at 40. As also seen in the drawings, the coils 38 terminate in a center wire which extends through the center of the element 34. The center wire 42 reacts with the coils 36 and 38 with the effect of reducing the actual length of the radiator element 34 while maintaining its electrical length. The coil radiator element 34 is preferably made from spring steel coated with copper or copper alloys such as phosphor bronze or other suitable materials. Radiator element 34 is positioned on coilform 30 so that the coils 36 and 38 embrace the outer surface of coilform 30 and so that the center wire 42 is received by the axial bore 32. The coilform 30 ensures that the center wire 42 is held perpendicular to the closed turn 40 and parallel to the coils 36 and 38. The radiator element 34 and coilform 30 are placed into the body member 20 so that the closed turn 40 makes contact with the flat surface of end 16 of stud 12. The insulating sheath 43 is placed over the body member 20, as seen in FIG. 1, and is a close fit on the body 20 and is held in place by ribs 44 on body member 20 and ribs 46 on sheath 43. The arrangement of the body member 20, connector stud 12, radiator element 34 and sheath 43 is such that radiator element 34 is held in compression, thereby ensuring that good electrical contact is made between the connector stud 12 and radiator element 34.

It can therefore be seen that a novel stubby antenna has been described which provides a multiple frequency response radiating element for a wireless communications device. It can also be seen from the foregoing that the use of the center wire 42 enables the actual length of the radiator element 34 to be reduced while maintaining acceptable electrical performance. It can also be seen from the foregoing that a stubby antenna has been described wherein the connection between the radiator element 34 and the antenna connector stud 12 is maintained by compressing the radiator element 34.

Thus it can be seen that the antenna of this invention accomplishes at least all of its stated objectives.

We claim:

1. A dual band stubby antenna for a wireless communications device having an antenna mounting opening formed therein, comprising:

a RF conductive connector stud having first and second ends;

said first end of said connector stud being adapted to be received by the antenna mounting opening for RF connection to the circuitry of the wireless communications device;

a coil radiator element having first and second ends;

said first end of said coil radiator element being in RF engagement with said second end of said connector stud;

said coil radiator element comprising a plurality of first coils adjacent said first end thereof and a plurality of second coils adjacent said second end thereof;

said second end of said coil radiator element terminating in a center wire which extends from said second end through the coils of said coil radiator element towards said first end thereof;

a body member having first and second ends;

said body member having a first opening extending into said first end thereof which receives said second end of said stud connector;

said second end of said body member having a cylindrical opening extending thereto which receives said coil radiator element;

and an insulating sheath enclosing at least a portion of said body member, wherein said coil radiator element is mounted on a cylindrical coilform having an axial boreformed therein, said center wire being received in said axial bore.

2. The antenna of claim 1 wherein said connector stud is press-fitted into said body member.

3. The antenna of claim 1 wherein said first plurality of coils has a different pitch than said second plurality of coils.

4. The antenna of claim 1 wherein said coil radiator element is in compression.

5. An antenna wherein said coil radiator element is in compression, a RF conductive connector stud having first and second ends;

said first end of said connector stud being adapted to be received by the antenna mounting opening for RF connection to the circuitry of the wireless communications device;

a coil radiator element having first and second ends;

said first end of said coil radiator element being in RF engagement with said second end of said connector stud;

said coil radiator element comprising a plurality of first coils adjacent said first end thereof and a plurality of second coils adjacent said second end thereof;

said second end of said coil radiator element terminating in a center wire which extends from said second end through the coils of said coil radiator element towards said first end thereof;

a body member having first and second ends;

said body member having a first opening extending into said first end thereof which receives said second end of said stud connector;

said second end of said body member having a cylindrical opening extending thereto which receives said coil radiator element;

and an insulating sheath enclosing at least a portion of said body member, wherein said coil radiator element is in compression.

* * * * *